US005996183A

United States Patent [19]

Prandini et al.

[11] Patent Number: 5,996,183

[45] Date of Patent: Dec. 7, 1999

[54] DEVICE FOR CONTROLLING TEXTILE FIBERS FLOATING THROUGH DRAWING CYLINDERS IN A COMBING MACHINE

[76] Inventors: Girolamo Prandini; Giovanni Battista Pasini, both of Via S. Alberto, 2, 25036 Palazzolo sull'Oglio, Brescia, Italy

[21] Appl. No.: 09/187,569

[22] Filed: Nov. 5, 1998

[30] Foreign Application Priority Data

Nov. 7, 1997 [IT] Italy ..... MI97A2499

[51] Int. Cl.[6] ..... D01H 5/32

[52] U.S. Cl. ..... 19/239; 19/236; 19/288

[58] Field of Search ..... 19/150, 152, 115 R, 19/157, 236, 237, 239, 242, 250, 251, 258, 287, 288, 290; 57/315

[56] References Cited

U.S. PATENT DOCUMENTS 4,062,175 12/1977 Ghidelli ..... 19/237
4,430,774 2/1984 Bothner ..... 19/258
4,547,936 10/1985 Bacchio ..... 19/258
4,920,736 5/1990 Stahlecker ..... 19/236

*Primary Examiner*—Michael A. Neas
*Assistant Examiner*—Gary L. Welch
*Attorney, Agent, or Firm*—Bucknam and Archer

[57] ABSTRACT

A device for controlling textile fibers floating through drawing cylinders in a combing machine comprises a plurality of drawing rollers on each of which a rubber roller is pressed, the device further comprising a stationary rod which can be applied, with an adjustable height, to the drawing cylinder assembly, and having a rod contour having a circle arch cross-section facing one of the drawing roller to press on the sliver being drawn, the rod being arranged between the second and third rubber rollers therethrough the sliver passes, the circle arch cross-section contour facing the third drawing roller.

12 Claims, 3 Drawing Sheets

DEVICE FOR CONTROLLING TEXTILE FIBERS FLOATING THROUGH DRAWING CYLINDERS IN A COMBING MACHINE

BACKGROUND OF THE INVENTION

The present invention relates to a device for controlling textile fibres floating through drawing cylinders of a drawing cylinder assembly in a combing machine.

A very important operation performed by a combing machine, during the spinning of cotton fibers, is that of assembling the slivers made by processing fiber laps coming from a drawing-assembling apparatus to transform said slivers, by a drawing operation, into a single even cross-section sliver.

This operation is conventionally carried out by a drawing assembly which is arranged on a side of the central body of the combing machine including therein a plurality of combing heads, said drawing assembly comprising a plurality of drawing cylinders therethrough the sliver to be drawn is caused to sequentially pass.

The cylinder assemblies are driven with different driving speed, to reduce the size of the sliver without interrupting its continuity.

During the above mentioned drawing operation, the floating fibers, i.e. the fibers starting and ending ends thereof are not engaged contemporaneously by a pair of subsequent rollers, must be properly controlled.

This problem has been solved in the prior art by using one or more movable rollers, of different geometrical configurations depending on the characteristics lengths of the fibers being processed.

However, in these prior art solutions, the fibers of the slivers being laminated are either arranged with a parallel sequential relationship, or they are arranged in a cascade relationship.

Actually, said sliver arrangements allow the floating fibers to be easily controlled by the mentioned movable roller devices.

However, as is known, the fibers exiting a combing machine have different characteristics, thereby the floating fibers control is much more difficult than the control of the fibers exiting a drawing machine or the like.

In order to better understand the nature of this problem, it would be useful to consider the method by which a combing machine, starting from the fiber laps, forms the sliver to be drawn.

For making the sliver, the combing machine combs the laps by portions, the so-called combing tufts, and for a full revolution angle of a circular comb.

Each combing tuft is overlapped, at least partially, on the preceding combing tuft, and then said combing tufts are pressed and joined to one another by stripping cylinders.

The above subsequent operations provide fiber slivers the floating fibers of which can be hardly controlled.

Thus, it has been experimentally found that the use of the above mentioned prior movable rollers, does not provide satisfactory results from a fiber sliver quality standpoint.

SUMMARY OF THE INVENTION

Accordingly, the aim of the present invention is to provide a device for controlling the floating fibers entrained between drawing cylinders of drawing assemblies included in combing machines, allowing to obtain a fiber sliver having a very even diameter at the outlet of the drawing assembly.

According to one aspect of the invention, the above mentioned aim is achieved by a device for controlling floating fibers between the cylinders of a drawing cylinder assembly included in a combing machine, said drawing assembly including a plurality of drawing rollers on each of which a rubber roller is pressed, characterized in that said device comprises a stationary rod, to be applied to said drawing assembly, and having a circle arch cross-section contour, facing one of said drawing rollers to press on the fiber sliver being drawn.

The invention provides, with respect to the prior art status, the following advantages.

At first, it should be pointed out that, by using the control device according to the invention, a fiber sliver having a very even cross section is made.

This will allow to produce a much more even yarn, thereby any breakage of the yarn can be safely overcome, with a consequent much more even operation of the textile loom, thereby greatly reducing the operating time and cost.

Moreover, the very even yarn thereby made will in turn provide very satisfactory cloth articles free of uneven textile fibers.

BRIEF DESCRIPTION OF THE DRAWINGS

Further advantages and characteristics of the present invention will become more apparent hereinafter from the following illustrative but not limitative disclosure, with reference to the accompanying drawings, where.

DESCRIPTION OF THE PREFERRED EMBODIMENTS

In the following disclosure, reference will be made to some preferred embodiments of the invention, which are illustrated, by way of a not limitative example of possible variations of the invention.

More specifically, it should be pointed out that the inventive device for controlling floating fibers in combing machines can be applied to a drawing cylinder assembly including either three rubber rollers and four drawing rollers or, alternatively, to a drawing cylinder assembly of the type including four rubber rollers and five drawing rollers or cylinders.

Figure 1:
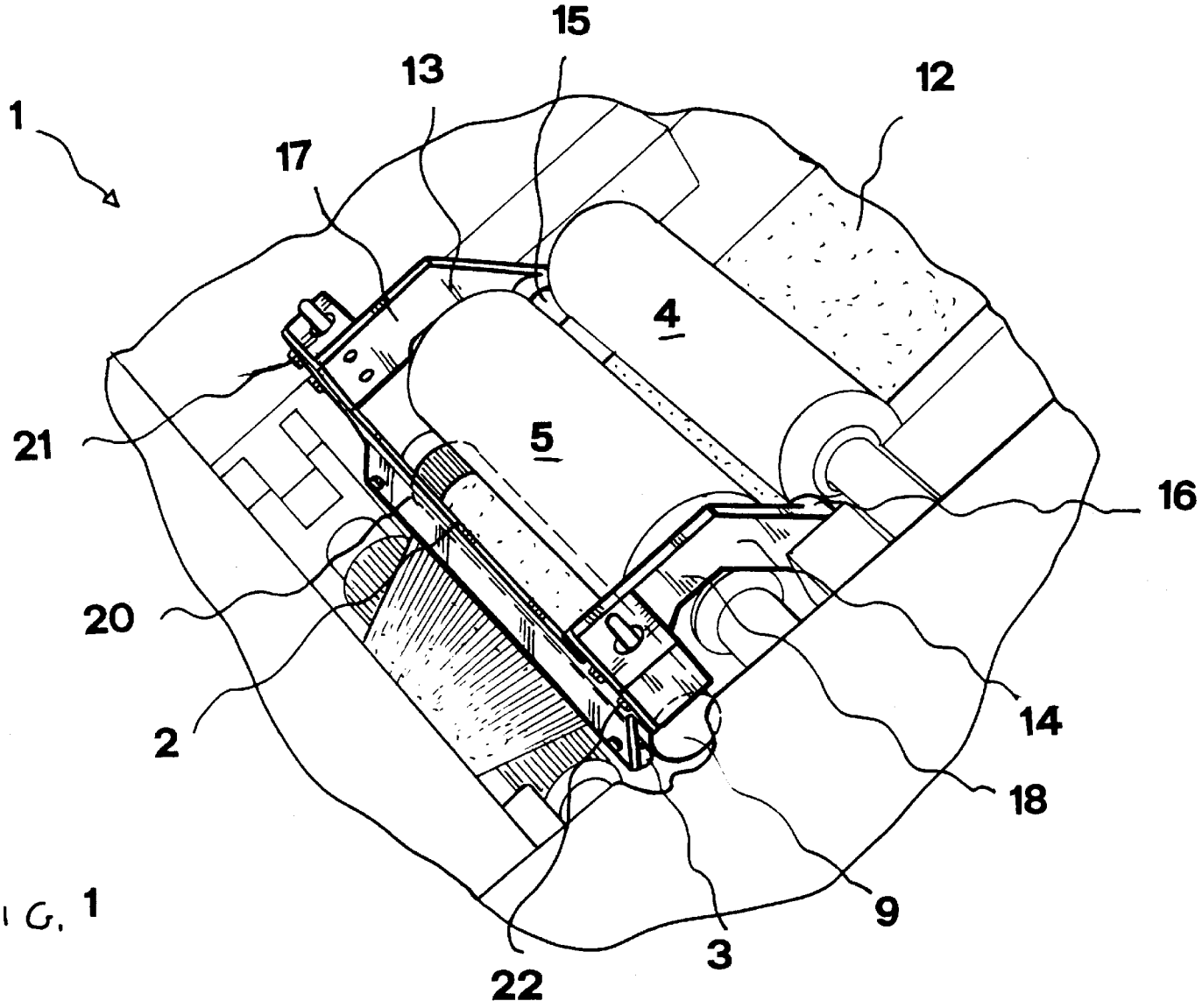
FIG. 1 is a perspective view of a detail of a drawing cylinder assembly included in a combing machine and provided with a control device for controlling floating fibers according to the present invention.
Figure 2:
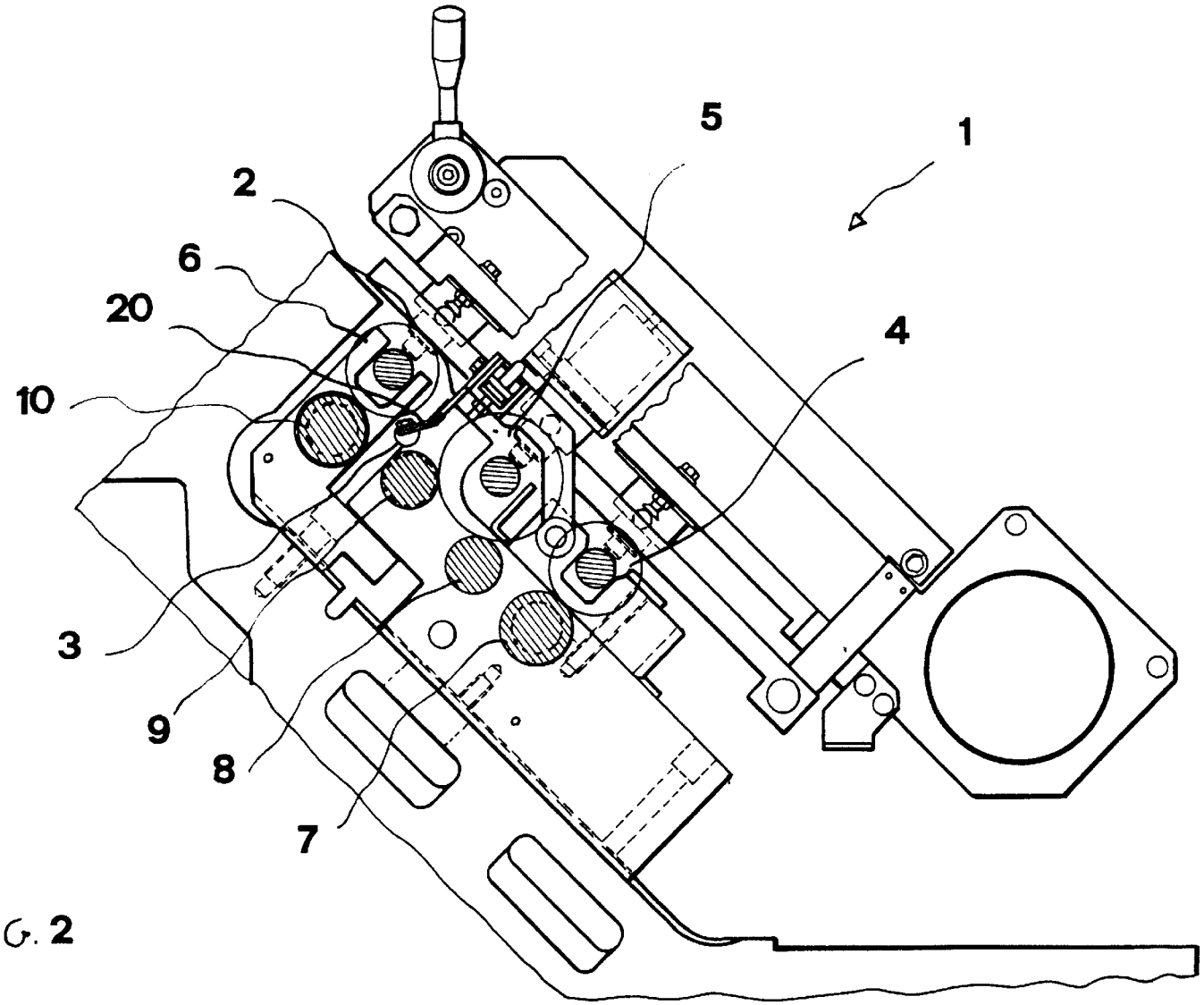
FIG. 2 is a cross-sectional view illustrating the drawing assembly, included in a combing machine, and provided with the floating fiber control device according to the invention.

FIG. 1 is a perspective view illustrating a detail of a drawing cylinder assembly 1 included in a combing machine and provided with the floating fiber control device according to the invention.

More specifically, the drawing assembly 1 comprises four fluted steel drawing cylinders or rollers 7, 8, 9 and 10 driven with different rotary speeds, which cooperate with three rubber rollers 4, 5 and 6 overlapping said drawing rollers, in order to draw a fiber sliver 12.

The floating fiber control device according to the invention comprises a stationary rod 2, applied to the drawing assembly 1, said rod including an angled portion 20 having a contour 3 of circle arch cross-section.

In particular, the rod 2 is arranged on the drawing assembly 1 to cause the rod contour 3 to face one of said drawing rollers, in particular the drawing roller 9, thereby said contour 3 and roller 9 will provide a passage for the fiber sliver 12 being processed.

Thus, the contoured portion 3 will operate as a stationary cylinder pressing on the fiber sliver 12 during the drawing operation.

The rod 2 is coupled to said drawing assembly 1 by a pair of angled support elements 13 and 14, each of which is provided with a respective portion 17 and 18, parallel to the working direction of the drawing assembly 1, which is slanted with respect to a horizontal line.

In turn, the angled support elements 13 and 14 are coupled to the drawing assembly 1 by a pair of eccentric pins 15 and 16.

The position of the rod 2 inside the drawing assembly and, consequently, the distance of the contoured portion 3 from the drawing roller 9, can be adjusted by suitably operating the eccentric pin pair 15 and 16.

Preferably, the rod 2 is coupled to the angled support elements 13 and 14 by screws 21 and 22 or like coupling elements.

The floating fiber control device according to the invention operates as follows.

The sliver being processed 12 is fed through a path defined by the drawing rollers 7, 8, 9 and 10 and rubber rollers 4, 5 and 6, and in particular, being fed through the gap defined by the roller 9 and contoured portion 3 rigid with said rod 2.

Thus, as the sliver 12 is fed, the contoured portion 3 will press on said sliver, thereby causing the fibers not simultaneously engaged by the pair of rollers 5 and 9 and pair of rollers 6 and 10 to adhere against one another, so as to increase the specific friction between a fiber and the fibers engaged therewith.

In other words, the contoured portion 3 will affect the floating fibers by controlling their movements between the rollers 5, 9 and 6, 10.

This operation of the contoured portion 3 on the fiber sliver 12 will provide a drawn fiber sliver of very even cross-section.

In this connection it should be actually pointed out that, since the lamination of the fibers is provided by the rotary rollers, having fixed parallel axes, an advanced wear condition of a component will affect with the same frequency, i.e. at the same linear position of the sliver, an unevenness of the drawing work on the sliver, thereby providing a continuous variation of the sliver cross-section.

Figure 3:
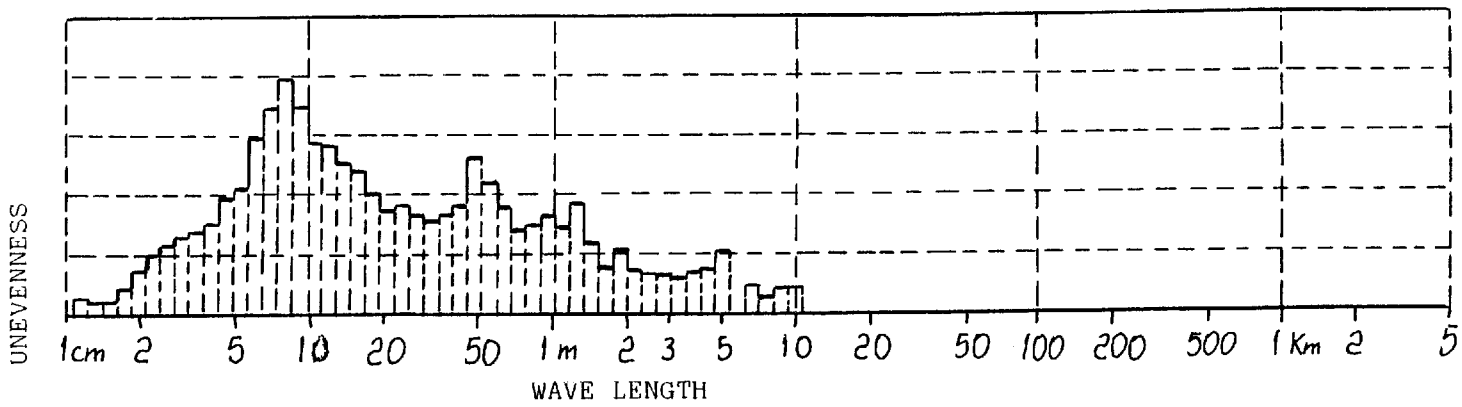
FIG. 3 is a diagram illustrating the floating mode of operation of floating fibers in a drawing cylinder assembly without the floating fiber control device according to the invention.
Figure 4:
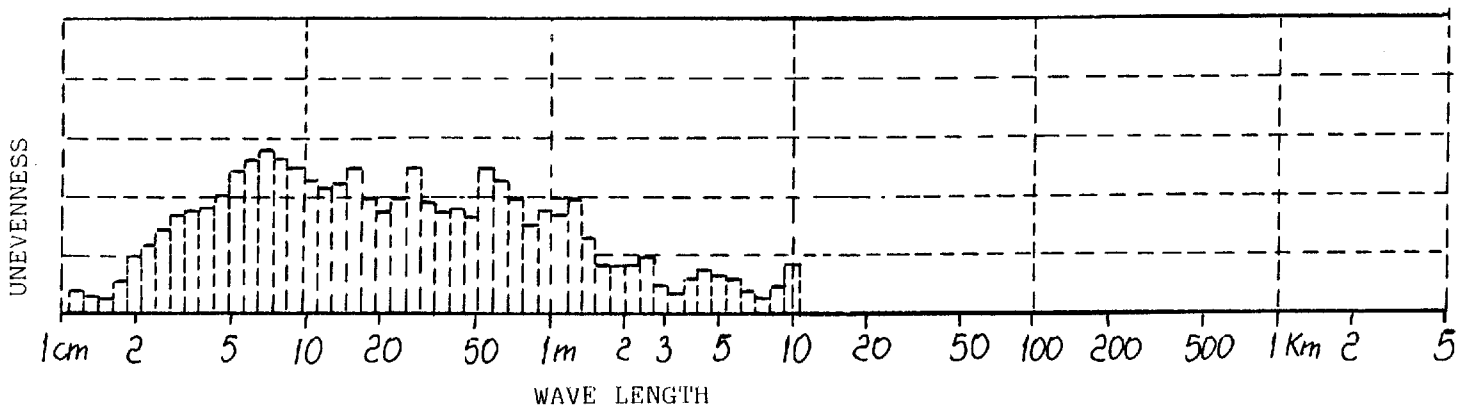
FIG. 4 is a diagram illustrating the floating mode of operation of floating fibers in a drawing cylinder assembly including the floating fiber control device according to the invention.

In order to clearly illustrate the improvement provided by the inventive device, reference is made to the diagrams of FIGS. 3–4 which have been made by using a laboratory instrument known with the name of Model Tester 3, and made by the Zellweger Uster —CH, which instrument is conventionally used for monitoring the unevenness of a fiber sliver.

The diagrams, which are conventionally called in this art "mass spectral diagrams" clearly show the periodic frequency of the sliver cross-section variations, by showing on the X-axis the wave length of the sliver cross section unevenness and putting on the Y-axis the average amplitude of said unevenness, on a logarithmic scale.

More specifically, the mass diagram of FIG. 3 shows that the period unevenness, i.e. the defect occurring at even time periods and originated by a drawing device of the prior art, has a maximum offset for a wave length from 5 to 10 mm.

This means that a uncontrolled or floating fibers migration occurs, causing a great unevenness of the fiber sliver between the pair of rollers 6 and 10 and pair of rollers 5 and 9, i.e. at a point of the sliver length from 5 to 10 mm, the application point of which represents the point of the rollers 6, 10 on the fibers.

The wave length of the periodic unevenness of th fiber sliver of the diagram of FIG. 4, i.e. after having applied the rod 2 with the contoured portion 3 guiding the floating fibers into the drawing device, is much more pressed toward the X-axis, thereby showing a better floating fibers control, provided by the inventive device, with a consequent very even cross-section sliver for the overall length thereof.

We claim:

1. A device for controlling textile fibers floating through drawing cylinders of a drawing cylinder assembly in a combing machine, said drawing cylinder assembly comprising a plurality of rigid driven drawing rollers on each of which a rubber roller is pressed, said device comprising a stationary rod arranged in said drawing assembly and having a circle arch cross-section contoured portion, said contoured portion being arranged in a fixed position facing one of said drawing rollers to press on the fiber sliver being drawn between said contoured portion and said one of said drawing rollers.

2. A device for controlling textile fibers floating through drawing cylinders of a drawing cylinder assembly in a combing machine according to claim 1, characterized in that said stationary rod comprises an angled portion to which said circle arch cross-section contoured portion is coupled.

3. A device for controlling textile fibers floating through drawing cylinders of a drawing cylinder assembly in a combing machine according to claim 1, characterized in that said rod is coupled to said d drawing assembly by a pair of angled support elements.

4. A device for controlling textile fibers floating through drawing cylinders of a drawing cylinder assembly in a combing machine according to claim 3, characterized in that each of said angled support elements is coupled to said drawing assembly by an eccentric pin provided for adjusting a distance of said contoured portion from the drawing roller said contoured portion is facing to.

5. A device for controlling textile fibers floating through drawing cylinders of a drawing cylinder assembly in a combing machine according to claim 3, characterized in that said rod is coupled to said angled support elements by screws.

6. A device for controlling textile fibers floating through drawing cylinders of a drawing cylinder assembly in a combing machine according to claim 1, characterized in that said rod is coupled to a drawing assembly including three rubber rollers and four drawing rollers.

7. A device for controlling textile fibers floating through drawing cylinders of a drawing cylinder assembly in a combing machine according to claim 1, characterized in that said rod is coupled to a drawing assembly including four rubber rollers and five drawing rollers.

8. A device for controlling textile fibers floating through drawing cylinders of a drawing cylinder assembly in a combing machine according to claim 1, characterized in that said rod is arranged between a second and third rubber rollers therethrough said fiber sliver passes, and that said circle arch cross-section contoured portion faces said third drawing roller.

9. A device for controlling textile fibers floating through drawing cylinders of a drawing cylinder assembly in a combing machine according to claim 1, characterized in that said rigid driven drawing rollers are each made of steel.

10. A device for controlling textile fibers floating through drawing cylinders of a drawing cylinder assembly in a combing machine according to claim 9, characterized in that said fixed position of said contoured portion with respect to said one of said drawing rollers is adjustable.

11. A device for controlling textile fibers floating through drawing cylinders of a drawing cylinder assembly in a combing machine according to claim 1, characterized in that said one of said drawing rollers at which said contoured portion faces is a penultimate drawing roller with respect to a drawing direction in a line of said plurality of drawing rollers.

12. A device for controlling textile fibers floating through drawing cylinders of a drawing cylinder assembly in a combing machine according to claim 11, characterized in that said rigid driven drawing rollers are each made of steel.

* * * * *